US007270339B2

(12) United States Patent
Feick

(10) Patent No.: US 7,270,339 B2
(45) Date of Patent: Sep. 18, 2007

(54) WHEELBARROW RACK

(76) Inventor: William Kurt Feick, 90 Lambert Rd., New Canaan, CT (US) 06840

( * ) Notice: Subject to any disclaimer, the term of this patent is extended or adjusted under 35 U.S.C. 154(b) by 0 days.

(21) Appl. No.: 11/259,908

(22) Filed: Oct. 27, 2005

(65) Prior Publication Data

US 2007/0096417 A1 May 3, 2007

(51) Int. Cl.
*B62B 1/00* (2006.01)
*B62B 3/00* (2006.01)
*A47B 57/00* (2006.01)

(52) U.S. Cl. ..... 280/79.3; 280/79.6; 280/79.7; 280/653; 280/47.35; 211/186; 211/190; 211/194

(58) Field of Classification Search ..... 280/79.3, 280/79.6, 79.7, 653, 47.35; 211/186, 190, 211/194

See application file for complete search history.

(56) References Cited

U.S. PATENT DOCUMENTS

| | | | | | |
|---|---|---|---|---|---|
| 972,447 | A * | 10/1910 | Harper | 211/27 |
| 1,598,727 | A * | 9/1926 | Jones | 248/159 |
| 3,638,814 | A * | 2/1972 | Lowery | 211/189 |
| 4,467,925 | A | 8/1984 | Ratzloff et al. | 211/60 T |
| 4,552,270 | A * | 11/1985 | Lentz et al. | 211/17 |
| 4,813,550 | A * | 3/1989 | Saeks | 211/17 |
| 4,895,381 | A * | 1/1990 | Farlow | 280/33.997 |
| 5,145,135 | A * | 9/1992 | Thompson | 248/201 |
| 5,762,210 | A | 6/1998 | Dahill | 211/60.1 |
| 6,220,463 | B1 * | 4/2001 | Pullen | 211/186 |
| 7,063,496 | B2 * | 6/2006 | Jackson et al. | 414/532 |
| 2003/0029818 | A1 * | 2/2003 | Kamphuis | 211/70.6 |
| 2004/0150177 | A1 * | 8/2004 | Thiede et al. | 280/79.3 |

* cited by examiner

*Primary Examiner*—Christopher P. Ellis
*Assistant Examiner*—John R. Olszewski
(74) *Attorney, Agent, or Firm*—St. Onge Steward Johnston & Reens LLC

(57) ABSTRACT

A wheelbarrow rack is disclosed generally comprising first and second rack stands, first and second upright posts connected to the first and the second rack stands respectively, multiple wheelbarrow support braces pivotally attached between the upright posts, and multiple stopper ledges attached to upright posts below the wheelbarrow support braces. In some embodiment, the wheelbarrow rack includes a spare wheel holding assembly attached to the rack. The method for conserving space while displaying or storing wheelbarrows is provided. Also, a method is provided for easy removal of the unwanted rainwater from wheelbarrows collected while displaying or storing wheelbarrows outside.

21 Claims, 5 Drawing Sheets

WHEELBARROW RACK

FIELD OF THE INVENTION

The present invention relates to an apparatus and method for storing wheelbarrows. More specifically, the invention relates to a wheelbarrow rack capable of storing multiple wheelbarrows.

BACKGROUND OF THE INVENTION

Wheelbarrows are widely used in both commercial and private settings. In commercial settings construction workers may use wheelbarrows to transport supplies, waste debris, mixed concrete, and other materials as needed from point to point. In private settings, landscapers and gardeners may use wheelbarrows to aid in transporting rocks, soil and potting material, and other tools from a supply location to a work site.

Because of the popularity of wheelbarrows, stores must carry a large inventory of them, especially during summer months. However, since wheelbarrows tend to occupy a lot of space due to their shape and size, most stores can only carry a limited inventory of wheelbarrows due to restrictions in the amount of space that can be dedicated to storing wheelbarrows. This results in lost sales.

Information relevant to attempts to address these problems can be found in U.S. Pat. Nos. 4,467,925 and 5,762,210. However, although the inventions disclosed in these references may be helpful in a private setting, they are only capable of holding a single wheelbarrow and, thus, are not adequate in the commercial settings or in private settings where a person owns multiple wheelbarrows.

Therefore, there is a need for a wheelbarrow rack capable of easy and convenient storage of multiple wheelbarrows. What is also needed is a wheelbarrow rack that enables multiple wheelbarrows to occupy the same floor space as a single wheelbarrow. What is further needed is a method for conserving storage space while storing or displaying wheelbarrows. Finally, there is a need be able to remove unwanted rainwater from a wheelbarrow collected while displaying or storing wheelbarrows outside.

SUMMARY OF THE INVENTION

Accordingly, it is an object of the present invention to provide a wheelbarrow rack capable of easy and convenient storage of multiple wheelbarrows.

It is a further object of the present invention to provide a wheelbarrow rack that enables multiple wheelbarrows to occupy the same floor space as a single wheelbarrow.

It is a further object of the invention for the bottom wheelbarrows to easily roll under the upper wheelbarrows without major obstruction from the wheelbarrow stand.

It is yet another object of the present invention to provide a method for conserving storage space while storing or displaying wheelbarrows.

It is still another object of the present invention to provide a wheelbarrow rack that allows the user to remove unwanted rainwater from a wheelbarrow collected while displaying or storing wheelbarrows outside.

It is another object of the invention to store replacement tires on the same wheelbarrow rack.

In order to overcome the deficiencies of the prior art and to achieve at least some of the objects and advantages listed, one embodiment of the present invention comprises two rack stands, two upright posts attached to rack stands so the upright posts are parallel to each other, multiple support braces adapted to support wheelbarrows and pivotally attached to the upright posts, and multiple stopper ledges attached to one or both upright posts below each support brace. The support braces are spaced apart to be able to accept a wheelbarrow. The distance between the support brace and the stopper ledge is such that when the brace rests on the corresponding stopper ledge the wheelbarrow supported by the support brace is in horizontal position.

To meet some objects of the invention, a method is provided for conserving space while displaying or storing wheelbarrows, comprising assembling a wheelbarrow rack and installing a wheelbarrow onto the support brace wherein the wheelbarrow is fully supported by the support brace. The wheelbarrow rack employed in this method comprises two rack stands, two upright posts attached to rack stands so the upright posts are parallel to each other, multiple support braces adapted to support wheelbarrows and pivotally attached to the upright posts, and multiple stopper ledges attached to one or both upright posts below each support brace. The support braces are spaced apart to be able to accept a wheelbarrow. The distance between the support brace and the stopper ledge is such that when the brace rests on the corresponding stopper ledge the wheelbarrow supported by the support brace is in horizontal position.

The present invention also provides a method for easy removal of the unwanted rainwater from wheelbarrows collected while displaying or storing wheelbarrows outside. The method comprises assembling a wheelbarrow rack, installing a wheelbarrow onto the support brace wherein the wheelbarrow is fully supported by the support brace; and periodically pivoting support brace to pour out the accumulated water. The wheelbarrow rack employed in this method comprises two rack stands, two upright posts attached to rack stands so the upright posts are parallel to each other, multiple support braces adapted to support wheelbarrows and pivotally attached to the upright posts, and multiple stopper ledges attached to one or both upright posts below each support brace. The support braces are spaced apart to be able to accept a wheelbarrow. The distance between the support brace and the stopper ledge is such that when the brace rests on the corresponding stopper ledge the wheelbarrow supported by the support brace is in horizontal position.

In some embodiments of the invention, the rack stand comprises a horizontal base with two casters attached to the bottom of the base at each end. The casters allow the rack to be easily moved around if necessary. For added convenience, locking casters can be used. A vertical member is attached to the base to facilitate the connection of the upright members to the rack stand. For example, the vertical member can be inserted into the upright member. To improve the strength and stability of the rack, the rack stands can be connected to each other using a bottom brace.

In another embodiment, to simplify the assembly of the rack, in one embodiment, the upright member comprise middle part and top end. The middle part is connected to the rack stand by sliding the bottom end of the middle part over the vertical member of the rack stand. The top end of the middle part is then inserted into the bottom end of the upper part of the upright member.

Each support brace may comprise a substantially rectangular frame and two bars located on the longer side of the rectangular frame. These bars support a wheel axle of a wheelbarrow held by the support brace. The bars are spaced apart to accept a wheel of a wheelbarrow having a single wheel or to straddle wheels of a wheelbarrow having two wheels. Although the number of braces can be varied to suit the needs of individual users, it is preferable to limit the number of wheelbarrow support bases to two in order to make the rack easier to assemble and use.

In yet another embodiment, the invention includes at least one spare wheel holding assembly. Storing spare wheels in the same location as the wheelbarrows allows the user to easily locate them when necessary. The holding assembly comprises the first member, and a second member attached to the first member at angle greater than 90 degrees. The assembly is then connected to the upright member of the rack. One way to connect the assembly to the upright member is by attaching at least one channel to the upright member of the rack and then inserting the first member of the holding assembly into these channels. This method of connection allows the spare wheel holding assembly to be easily moved out of the way if necessary by swinging the assembly to the side of the rack.

DETAIL DESCRIPTION OF THE DRAWINGS

Figure 1:
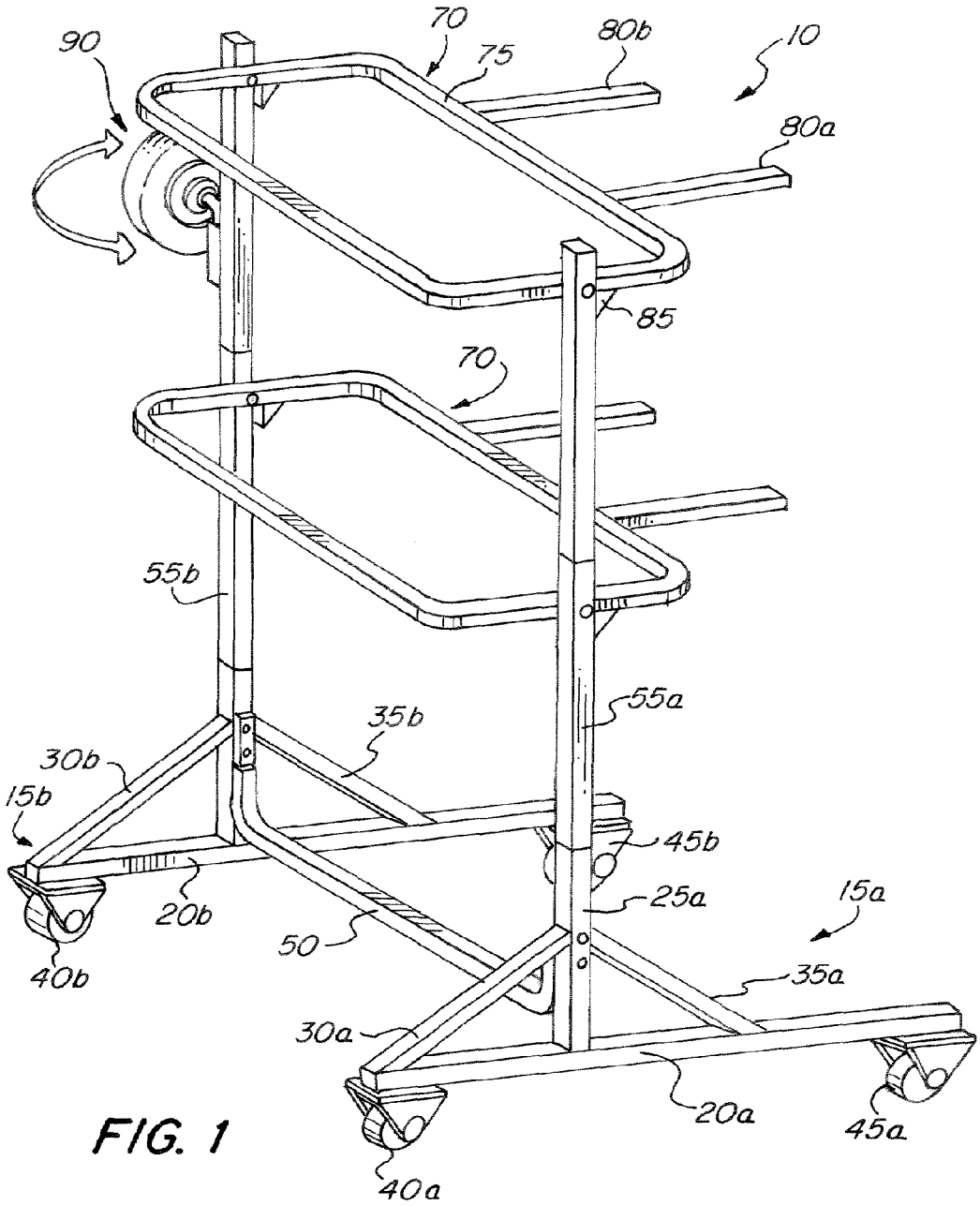
FIG. 1 is a perspective view of wheelbarrow in accordance with the invention.

The basic components of one embodiment of a wheelbarrow rack in accordance with the invention are illustrated in FIG. 1. As used in the description, the terms "top," "bottom," "above," "below," "over," "under," "above," "beneath," "on top," "underneath," "up," "down," "upper," "lower," "front," "rear," "back," "forward" and "backward" refer to the objects referenced when in the orientation illustrated in the drawings, which orientation is not necessary for achieving the objects of the invention.

Figure 2:
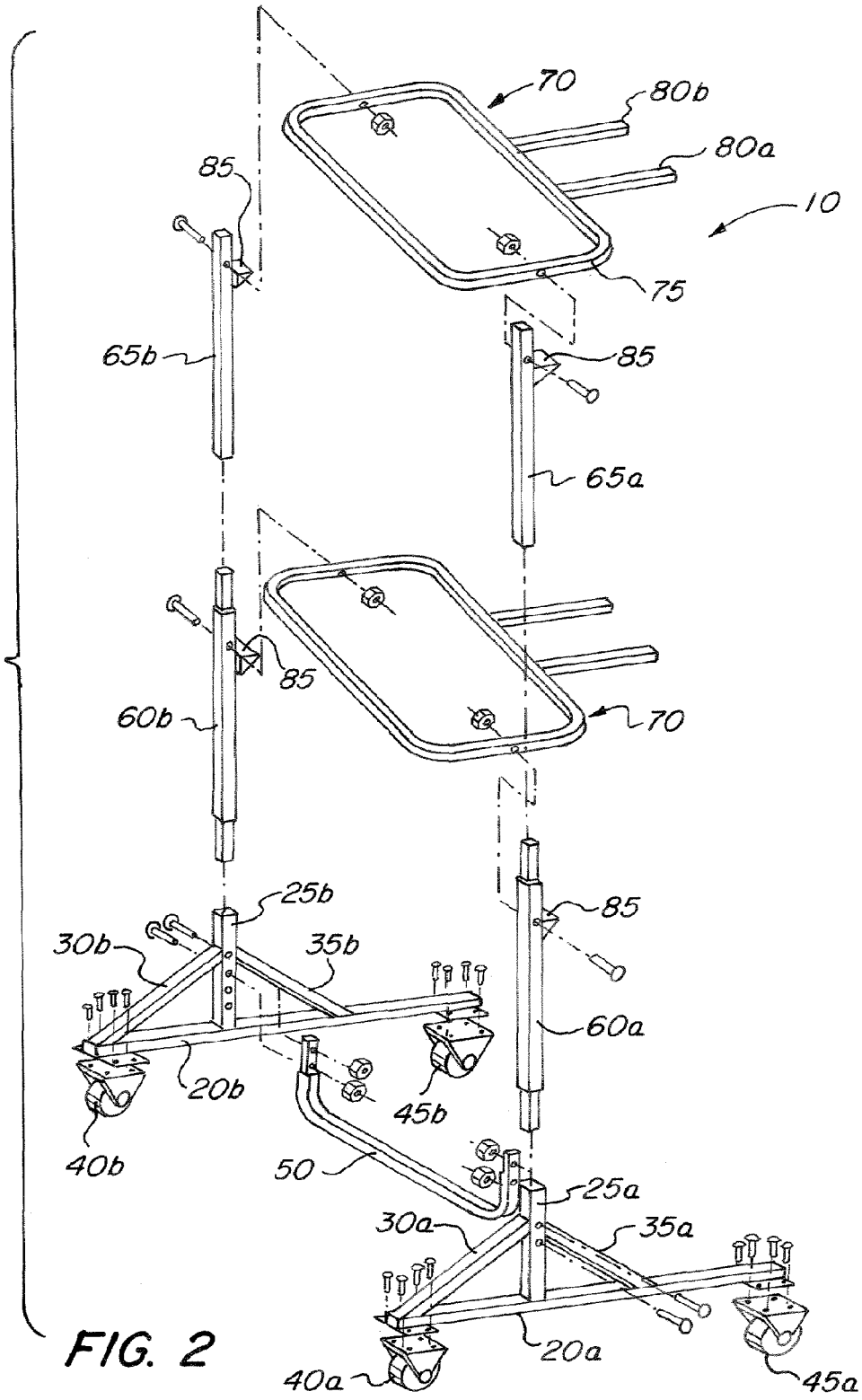
FIG. 2 is an exploded view of the wheelbarrow rack of FIG. 1.

Referring to FIGS. 1 and 2, the wheelbarrow rack 10 is illustrated in accordance with the concepts and principles of the present invention. The rack 10 includes rack stands 15*a* and 15*b*, upright posts 55*a* and 55*b*, wheelbarrow support braces 70, and stopper ledges 85. The individual components of the rack 10 are described in details below.

Rack stand 15*a* consists of a horizontal base 20*a* having two ends 21*a* and 22*a*. A vertical member 25*a* is attached to the horizontal base 20*a* at about one-third of the distance between the ends of horizontal base 20*a* from the end 21*a*. In some embodiments, the vertical member 25*a* is supported by two support members 30*a* and 35*a* to increase stability of the rack. The support member 30*a* extends from the end 21*a* of the base 20*a* to about one-third of the length of the vertical member 25*a* from the top of the vertical member. The support member 35*a* extends from about one-third of the distance between the ends of the horizontal base 20*a* from the end 22*a* to about one-third of the length of the vertical member 25*a* from the top of the vertical member 25*a*.

Two casters 40*a* and 45*a* are attached to the bottom of horizontal base 20*a* at the corresponding ends 21*a* and 22*a* using bolts. Use of casters allows to easily move the wheelbarrow rack around the storage area or outside if necessary. In some embodiments of the invention, one or both locking casters can be used in order to allow the user to secure the rack in place.

Similarly, the rack stand 10*b* comprises a horizontal base 20*b*, vertical member 25*b*, support members 30*b* and 35*b*, and casters 40*b* and 45*b*. The relation between the components of the rack stand 15*b* is the same as the relation between the corresponding components of the rack stand 15*a*.

The rack stands 15*a* and 15*b* are connected by the bottom brace 50. The brace 50 is affixed to the vertical members 25*a* and 25*b* using bolts. In one embodiment the bottom brace 50 has a shape of a horseshoe where the ends of the brace are connected to the vertical members 25*a* and 25*b*. Connecting the rack stands 15*a* and 15*b* using the bottom brace 50 increases the strength and stability of the rack 10. The horseshoe is designed to have enough clearance so that the rack can be transported through doorways and over grates but is low enough for a wheelbarrow to be easily pulled over the cross bar without dislodging or rolling the rack.

The upright posts 55*a* and 55*b* are connected to the rack stands 10*a* and 10*b* respectively. In one embodiment, the upright post 55*a* comprises a middle part 60*a* and an upper part 65*a*. Similarly, the upright post 55*b* consists of a middle part 60*b* and an upper part 65*b*. The middle parts and the upper parts are connected by inserting the top end of the middle part into the bottom end of the upper part. The upright posts are attached to the rack stands by inserting the top end of vertical member into the bottom end of the middle parts. The inner diameter of the bottom end of the upper part and the outer diameter of the top end of the middle post are selected to ensure a tight fit between the upper and middle parts. Similarly inner diameter of the bottom end of the middle part and the outer diameter of the top end of the vertical member are selected to ensure a tight fit between the middle part and the vertical member. In some embodiments, the upper post and middle post, and the middle post and the vertical member can be affixed to each other more permanently using any known method.

Figure 3:
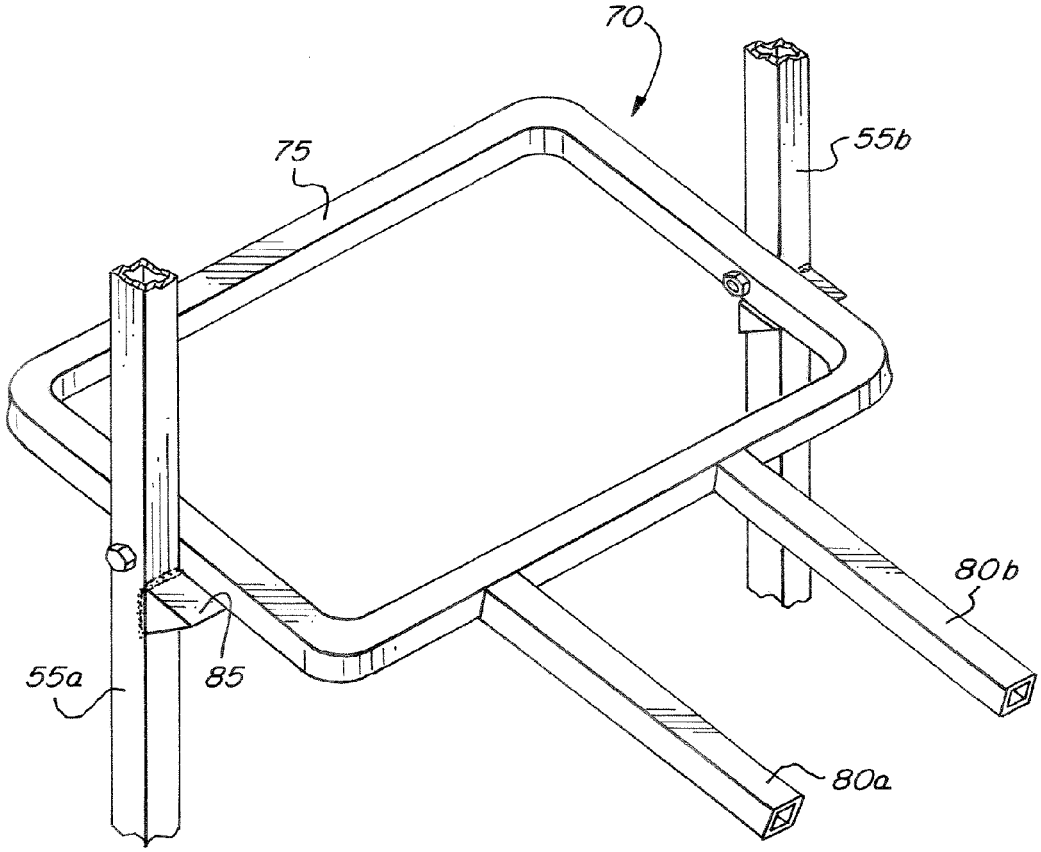
FIG. 3 is a perspective view illustrating the details of a wheelbarrow support brace and stopper ledges attachment to the wheelbarrow rack of FIG. 1.

As shown in FIG. 3, the wheelbarrow support braces are pivotally attached to the first and second upright members. The support braces are made of material able to support wheelbarrow's weight without deformation. Referring back to FIGS. 1 and 2, in one embodiment, each support brace 70 comprises a rectangular frame 75 and two bars 80*a* and 80*b* disposed on the longer side of the frame 75. The bars 80*a* and 80*b* are designed to support a wheel axle of a wheelbarrow resting on the support brace. Therefore, they are spaced apart to be able to receive a wheel of a wheelbarrow having a single wheel and straddle the wheels of a wheelbarrow having two wheels. Although the preferred embodiment of the invention includes two support braces, the number of braces can be varied to suit the needs of a specific end user.

Figure 5:
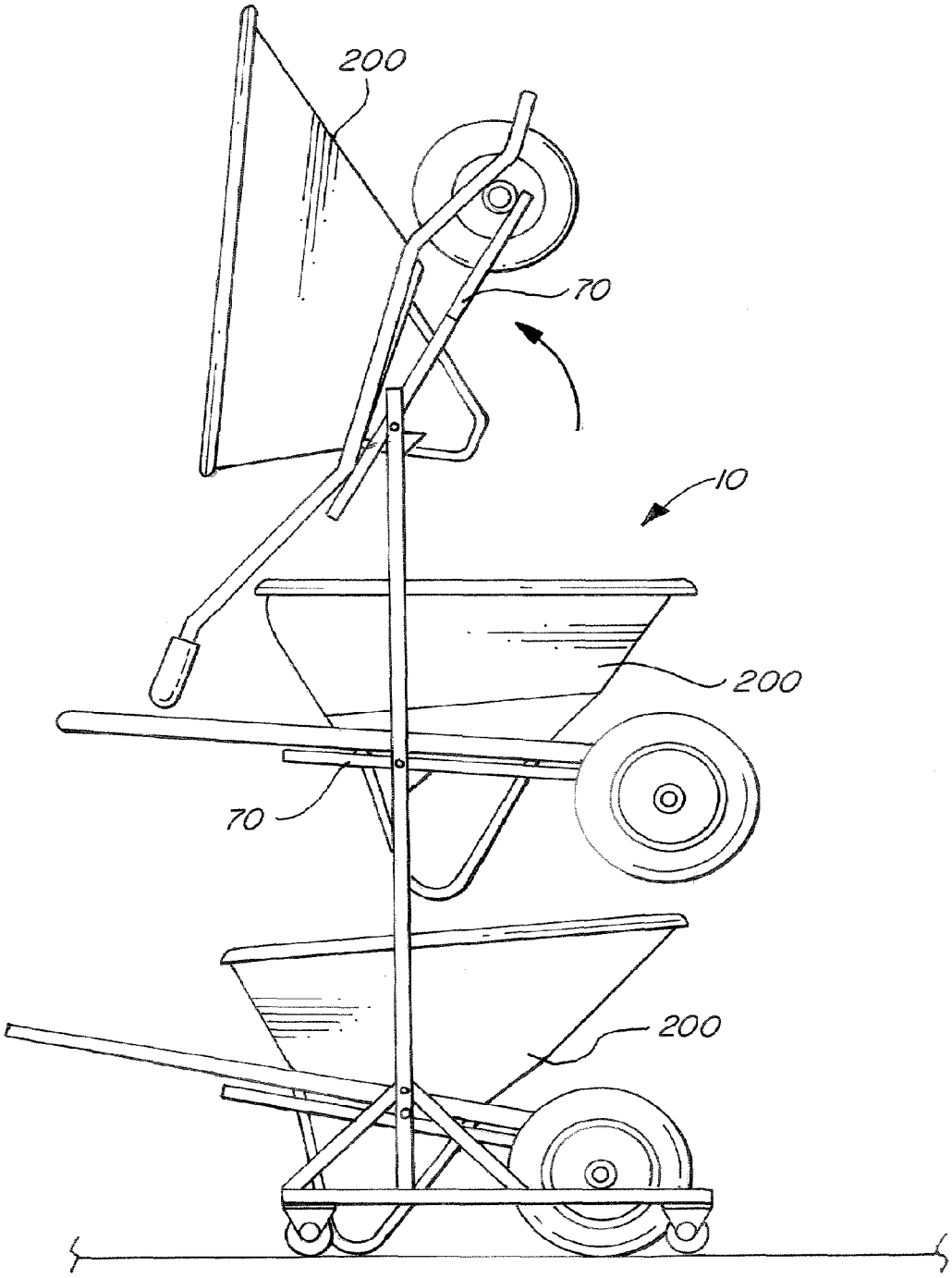
FIG. 5 illustrates the use of the wheelbarrow rack of FIG. 1.

As shown in FIG. 3, a triangular stopper ledge 85 is connected to at least one of the upright posts below each support brace. The stopper ledge 85 can be connected to the upright post permanently by welding as shown in FIG. 3 or removably by using bolts. This stopper ledge prevents the support brace from tipping forward. The distance between the support brace 70 and the stopper ledge 85 is such that when the support brace 70 rests on the stopper ledge 85, the wheelbarrow supported by the brace 70 is in horizontal position as shown in FIG. 5. In some embodiments, one stopper ledge can be attached to each of the upright posts below the wheelbarrow. This embodiment is preferred when the wheelbarrows stored on the rack are exceptionally heavy in order to prevent deformation or failure of the stopper ledge by distributing the weight of the wheelbarrow over two ledges. Even when storing standard wheelbarrows, two stopper ledges can be used to prevent the support braces from tipping forward if one of the stopper ledges fails.

Figure 4:
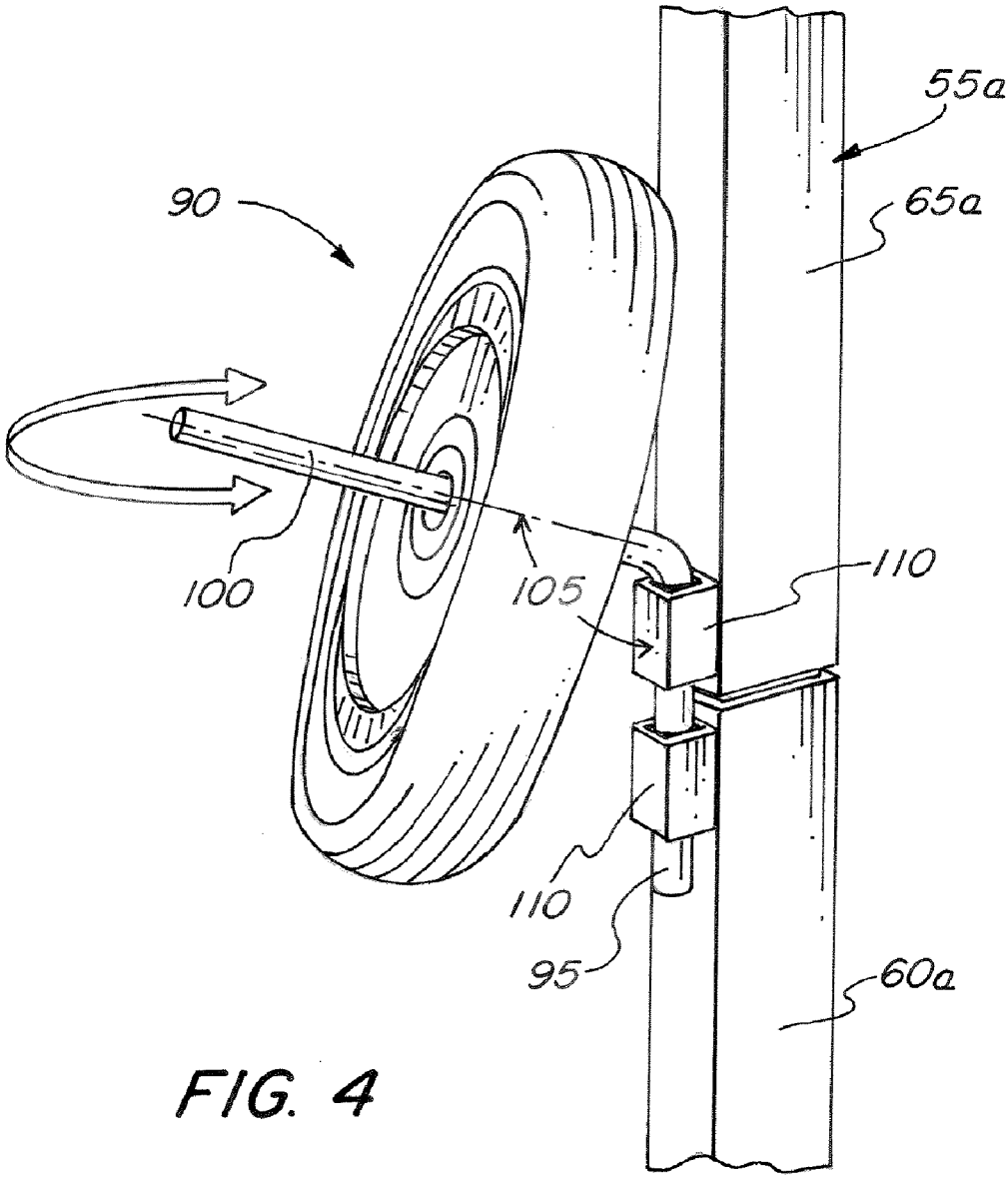
FIG. 4 illustrates the details of the spare wheel holding assembly included in some embodiment of rack of FIG. 1.

In some embodiments, at least one spare wheel holding assembly 90 is attached to the rack. Referring to FIG. 4, the wheel holding assembly 90 includes a first component 95 and a second component 100 where the angle 105 formed by these components is more than 90 degrees. The first component 95 is attached to one of the upright posts and is parallel to that post. One preferable method of attachment is to attach one or more appropriately sized hollow metal channels 110 to the upright post. One end of the first component 95 of wheel holding assembly 90 can be inserted into the channel 110 to hold the assembly 90 in place.

Most preferably, pairs of hollow metal channels 110 are provided, for example, with one of each pair of channels 110 positioned on the upper part 65*a* of upright post 55*a*, and the other of the pair of channels 110 positioned on the middle part 60*a* of upright post 55*a*, so that the placement of the first component 95 of the wheel holding assembly 90 through both channels 110 increases the structural strength of the joint 67*a* between the upper part 65*a* and middle part 60*a* of upright post 55*a*. In the same way, one of a pair of metal channels 110 can be positioned on the upper part 65*b*, and the other one of the pair positioned on the middle part 60*b* of upright post 55*b*, so that the placement of the first component 95 of a wheel holding assembly 90 through both channels 110 increases the structural strength of the joint between the upper part 65*b* and middle part 60*b* of upright post 55*b*.

The spare wheel holding assembly 90 allows the user to store the spare wheels below the wheelbarrows, allowing the user to readily locate spare wheels when necessary and also minimize the rack profile. On the other hand, the assembly can be rotated to the side of the rack when the wheelbarrows needs to be removed from the rack or tilted as described below, or when the rack is moved through a doorway. FIG. 1 shows wheel assembly located on the side of the rack.

Referring to FIG. 5, the operation of the wheelbarrow rack 10 is illustrated. First, the rack 10 subject of the present invention is assembled and wheelbarrows 200 are installed on the support braces. As can be seen, the rack permits three wheelbarrows 200 to occupy the same floor space as normally required by a single wheelbarrow. The three wheelbarrows 200 are located, respectively, on the floor, and on two pivoting wheelbarrow support braces 70. Thus, use of the wheelbarrow rack of this invention enables the users to conserve storage space. As seen in FIG. 5, the pivoting wheelbarrow support braces 70 permit installation or removal of a wheelbarrrow from the rack. Another aspect of the wheelbarrow rack shown in FIG. 5 is that the pivoting design allows the user to periodically tilt wheelbarrows and pour out rainwater that can collect inside the wheelbarrow stored or displayed outside as illustrated by the tilted upper wheelbarrow 200 shown in FIG. 5.

It should be understood that the foregoing is illustrative and not limiting, and that obvious modifications may be made by those skilled in the art without departing from the spirit of the invention. Accordingly, reference should be made primarily to the accompanying claims, rather than the foregoing specification, to determine the scope of the invention.

What is claimed is:

1. A wheelbarrow rack, comprising:

a first rack stand;

a second rack stand;

a first upright post connected to the first rack stand;

a second upright post parallel to the first upright post and connected to the second rack stand;

a plurality of support braces adapted to support wheelbarrows, each support brace having a frame for receiving wheelbarrow stands and elements to receive and support a wheelbarrow wheel, said support braces being pivotally attached between the first and second upright posts wherein the support braces are vertically spaced apart sufficiently to permit positioning of wheelbarrows thereon;

a wheelbarrow positioned on at least one of said support braces; and a plurality of stopper ledges attached to at least one of the upright posts below each support brace wherein when the support brace rests on the corresponding stopper ledge a wheelbarrow supported by the brace is in a generally horizontal position;

said support braces being pivotable to tilt said wheelbarrow sufficiently to drain water collected in said wheelbarrow.

2. The wheelbarrow rack of claim 1, wherein the rack further comprises a bottom brace adapted to connect the first and the second rack stand.

3. The wheelbarrow rack of claim 1 further comprising at least two casters attached to each of the rack stands.

4. The wheelbarrow of claim 3, wherein one of the casters attached to each stand is a locking castor.

5. The wheelbarrow rack of claim 1 where each rack stand comprises a horizontal base having a top and a bottom and a first and a second end; a vertical member extending upwardly from said horizontal base approximately one-third of the distance between the ends of a horizontal base; and at least two casters attached to the bottom of the horizontal base.

6. The wheelbarrow rack of claim 5, wherein each upright post comprises a middle part and an upper part, said middle part being mounted to said vertical member of the rack stand.

7. The wheelbarrow rack of claim 1 having two support braces and 2 stopper ledges.

8. The wheelbarrow of claim 1 wherein each support brace comprises a substantially rectangular frame having two bars extending laterally from said rectangular base, said bars being spaced apart sufficiently to receive a wheelbarrow wheel.

9. The wheelbarrow rack of claim 1, further comprising at least one spare wheel holding assembly, where each tire holding assembly comprises:

a first component attached to one of the upright posts of the wheelbarrow rack parallel to that member; and a second component attached to the first member wherein the angle formed by the first member and the second member is greater than 90 degrees.

10. The wheelbarrow rack of claim 9 wherein the first component of the spare wheel holding assembly is inserted into at least one channel attached to one of the upright posts of the wheelbarrow rack.

11. The wheelbarrow rack of claim 10 wherein pairs of hollow metal channels are provided on sections of one or more of said upright posts whereby the first component of said spare wheel holding assembly extending between a pair of hollow metal channels increases the structural strength of a joint between said sections of said upright post.

12. A method for conserving space while displaying or storing wheelbarrows, comprising:

providing a wheelbarrow rack, the rack comprising a first rack stand;

a second rack stand;

a first upright post connected to the first rack stand;

a second upright post parallel to the first upright post and connected to the second rack stand;

a plurality of support braces adapted to support wheelbarrows, each support brace being pivotally attached between the first and second upright posts wherein the braces are spaced apart to accept wheelbarrows, said support braces having a frame for receiving wheelbarrow stands and elements to receive and support a wheelbarrow wheel;

a plurality of stopper ledges attached to at least one of the upright posts below each support brace wherein when the support brace rests on the corresponding stopper ledge a wheelbarrow supported by the brace is in a generally horizontal position, said support braces being pivotable to tilt said wheelbarrow sufficiently to drain water collected in said wheelbarrow; and installing a wheelbarrow onto the support brace wherein the wheelbarrow is fully supported by the support brace.

13. The method of claim 12, wherein the rack further comprises a bottom brace adapted to connect the first and the second rack stand.

14. The method of claim 12 wherein the support brace comprises a substantially rectangular frame and two bars disposed on the longer side of the frame for supporting a wheel axle of a wheelbarrow supported by the support brace wherein the bars are spaced apart to receive a wheel of a wheelbarrow having a single wheel or straddle the wheels of a wheelbarrow having two wheels.

15. The method of claim 12 wherein the wheelbarrow rack further comprises at least one spare wheel holding assembly, where each tire holding assembly comprises:

a first component attached to one of the upright members of the wheelbarrow rack parallel to that member; and a second component attached to the first component wherein the angle formed by the first member and the second member is greater than 90 degrees.

16. The method of claim 15 wherein the first component of the spare tire holding assembly is inserted into at least one channel attached to one of the upright post of the wheelbarrow rack.

17. The method of claim 16 wherein pairs of hollow metal channels are provided on sections of one or more of said upright posts whereby the first component of said spare wheel holding assembly extending between a pair of hollow metal channels increases the structural strength of a joint between said sections of said upright post.

18. The method of claim 12 further comprising at least two casters attached to each of the rack stands of the wheelbarrow rack.

19. A method of removing unwanted rainwater from a wheelbarrow collected while displaying or storing wheelbarrows:

providing a wheelbarrow rack, the rack comprising a first rack stand;

a second rack stand;

a first upright post connected to the first rack stand;

a second upright post parallel to the first upright post and connected to the second rack stand;

a plurality of support braces adapted to support wheelbarrows each support brace pivotally attached between the first and second upright posts wherein the braces are spaced apart to accept wheelbarrows, said support braces having a frame for receiving wheelbarrow stands and elements to receive and support a wheelbarrow wheel; and a plurality of stopper ledges attached to at least one of the upright posts below each support brace wherein when the support brace rests on the corresponding stopper ledge a wheelbarrow supported by the brace is in horizontal position;

installing a wheelbarrow onto the support brace wherein the wheelbarrow is fully supported by the support brace; and periodically pivoting said support braces to tilt said wheelbarrow to pour out accumulated water in said wheelbarrow.

20. The method of claim 19 wherein the support brace comprises a substantially rectangular frame and two bars disposed on the longer side of the frame for supporting a wheel axle of a wheelbarrow supported by the support brace wherein the bars are spaced apart to receive a wheel of a wheelbarrow having a single wheel or straddle the wheels of a wheelbarrow having two wheels.

21. The method of claim 19 wherein the wheelbarrow rack further comprises at least one spare wheel holding assembly, where each tire holding assembly comprises:

a first component attached to one of the upright posts of the wheelbarrow rack parallel to that member; and a second component attached to the first member wherein the angle formed by the first member and the second member is greater than 90 degrees.

* * * * *